US007080580B2

(12) United States Patent
Gordon

(10) Patent No.: US 7,080,580 B2
(45) Date of Patent: Jul. 25, 2006

(54) LUG WRENCH

(75) Inventor: Herman Gordon, Huntingdon Valley, PA (US)

(73) Assignee: Ameritech Auto Design Corporation, Southampton, PA (US)

( * ) Notice: Subject to any disclaimer, the term of this patent is extended or adjusted under 35 U.S.C. 154(b) by 0 days.

(21) Appl. No.: 10/461,908

(22) Filed: Jun. 13, 2003

(65) Prior Publication Data

US 2004/0250661 A1 Dec. 16, 2004

Related U.S. Application Data

(63) Continuation-in-part of application No. 10/360,788, filed on Jun. 13, 2002, now abandoned.

(51) Int. Cl.
*B25B 13/00* (2006.01)

(52) U.S. Cl. ..... 81/124.7; 81/177.1; 81/177.2

(58) Field of Classification Search ..... 81/124.7, 81/177.1, 177.2, 177.5; 7/100
See application file for complete search history.

(56) References Cited

U.S. PATENT DOCUMENTS 1,282,028 A 10/1918 Bellows
1,630,848 A 5/1927 Ivey
2,738,694 A 3/1956 Boatright
3,587,366 A 6/1971 Klein et al.
4,070,931 A 1/1978 Florko, Jr.
4,733,583 A 3/1988 Lewis
5,095,784 A * 3/1992 Garver ..... 81/466
5,685,207 A * 11/1997 Hubert ..... 81/177.5
5,797,659 A 8/1998 Fuller
D399,716 S * 10/1998 Carr ..... D8/21
6,257,104 B1 * 7/2001 Jarrett ..... 81/177.8

* cited by examiner

*Primary Examiner*—Lee D. Wilson
*Assistant Examiner*—Alvin J. Grant
(74) *Attorney, Agent, or Firm*—Synnestvedt & Lechner LLP; Gregory S. Bernabeo

(57) ABSTRACT

A lug wrench having a nut-receiving socket on a shank, and a crossbar joined to the shank to extend transversely, e.g. perpendicularly, thereto. The lug wrench may include a wedge or a second socket joined to the shank. First and second handle members are joined to the first and second ends, respectively, of the crossbar to extend transversely, e.g. perpendicularly, thereto. The handle members may extend substantially parallel to an axis of the shank. The crossbar may be joined to a middle portion of each of the handle members, or the crossbar may be joined to an end of the handle members such that the handle members may extend from the crossbar in a direction away from the socket. The lug wrench is preferably symmetrical about a plane that intersects the shank and is perpendicular to the crossbar to facilitate balanced application of force to a lug nut.

20 Claims, 11 Drawing Sheets

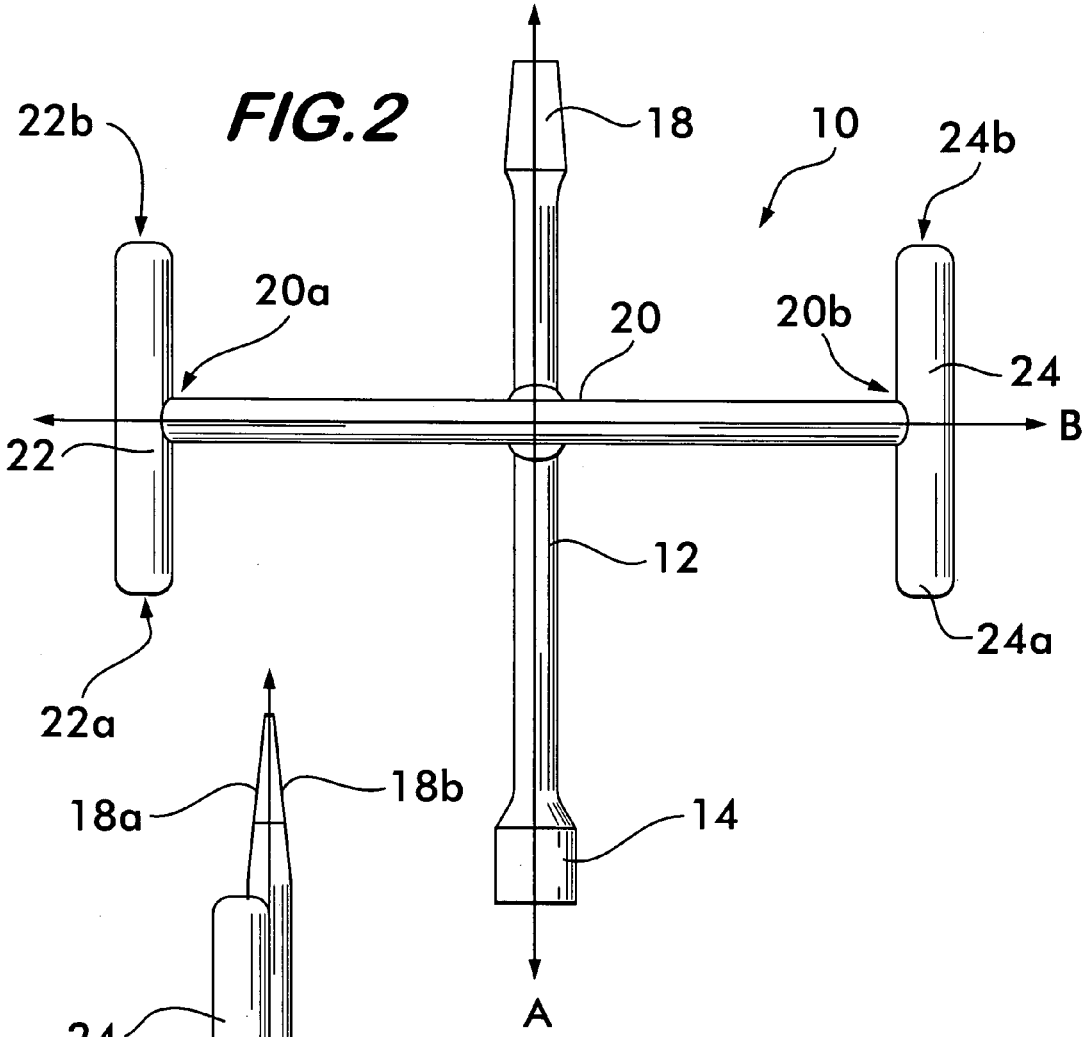
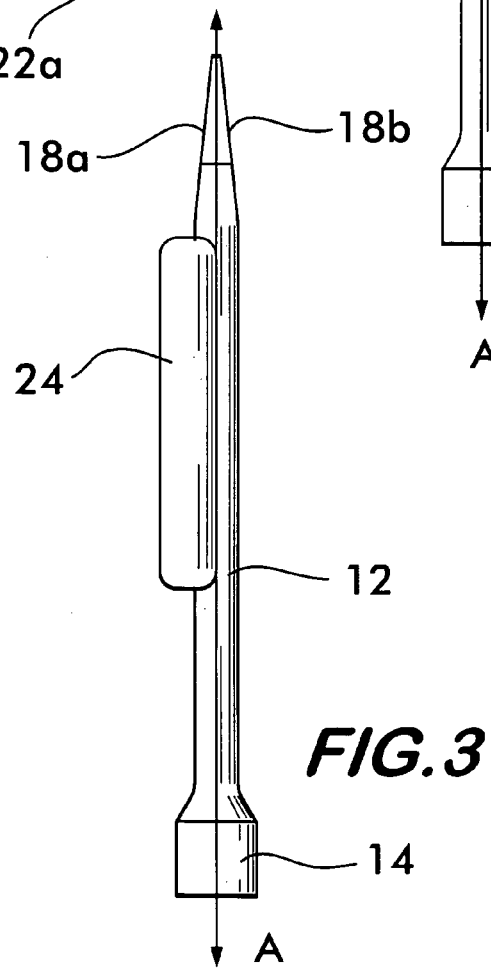
FIG.3

FIG. 11
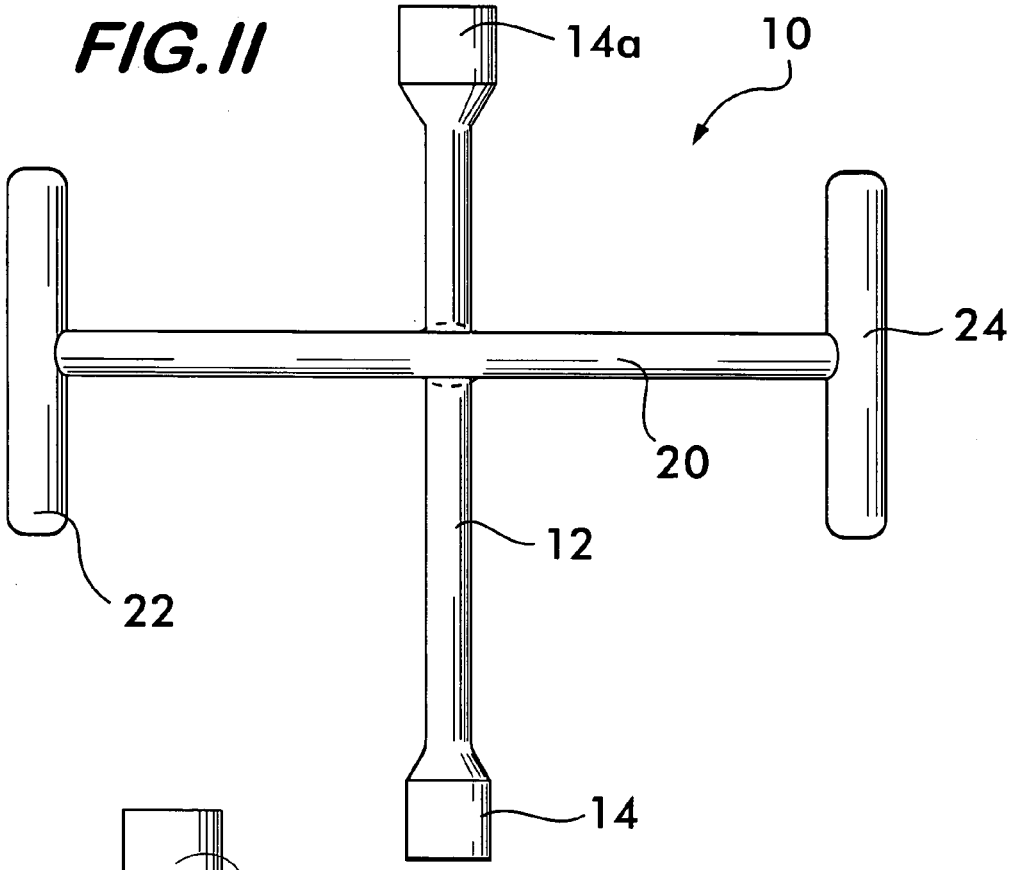
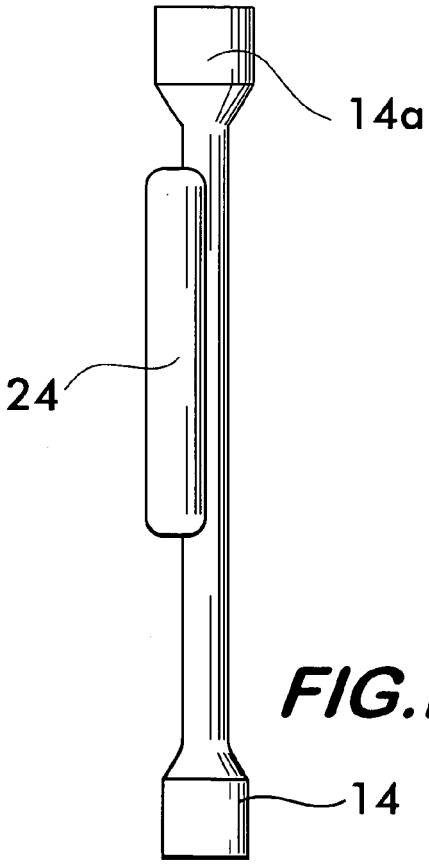
FIG. 12

FIG.20
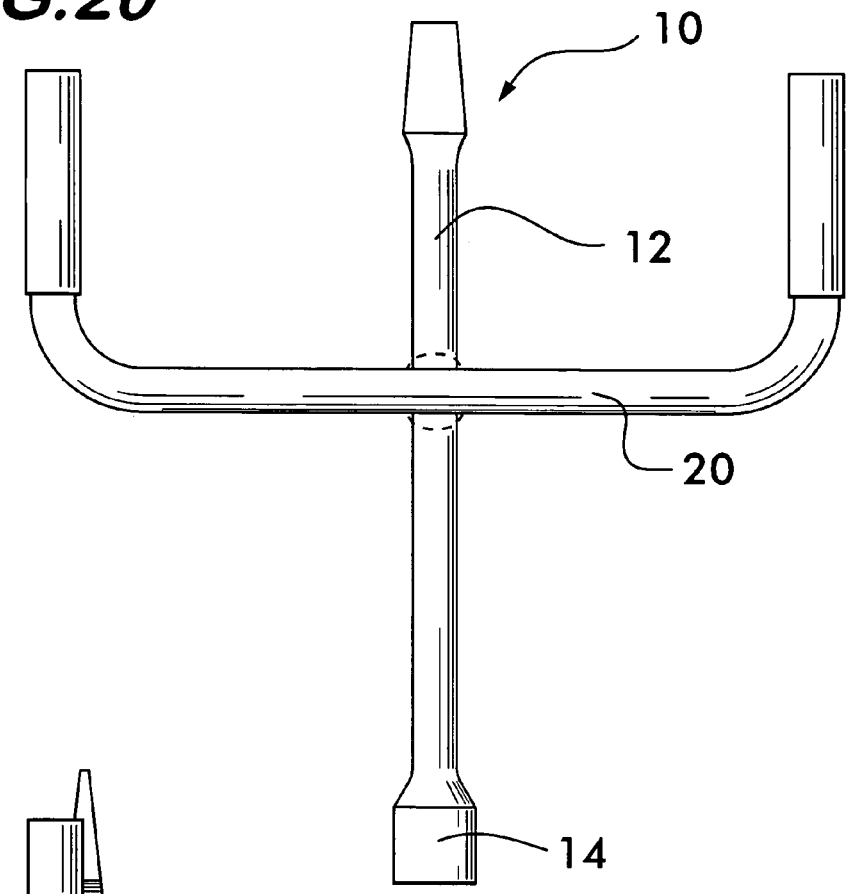
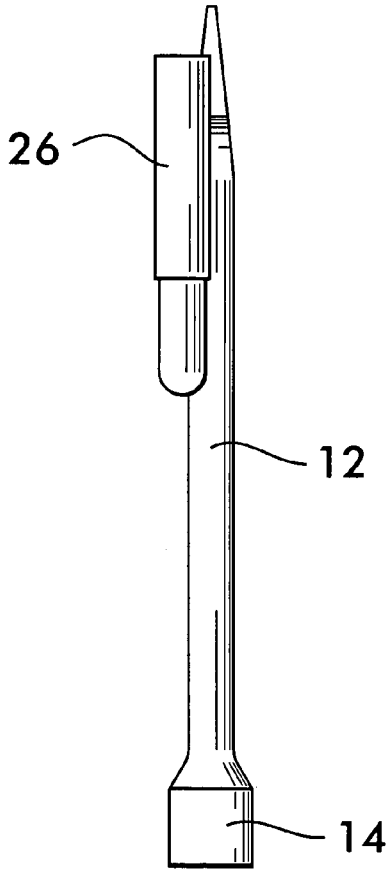
FIG.21

FIG.25
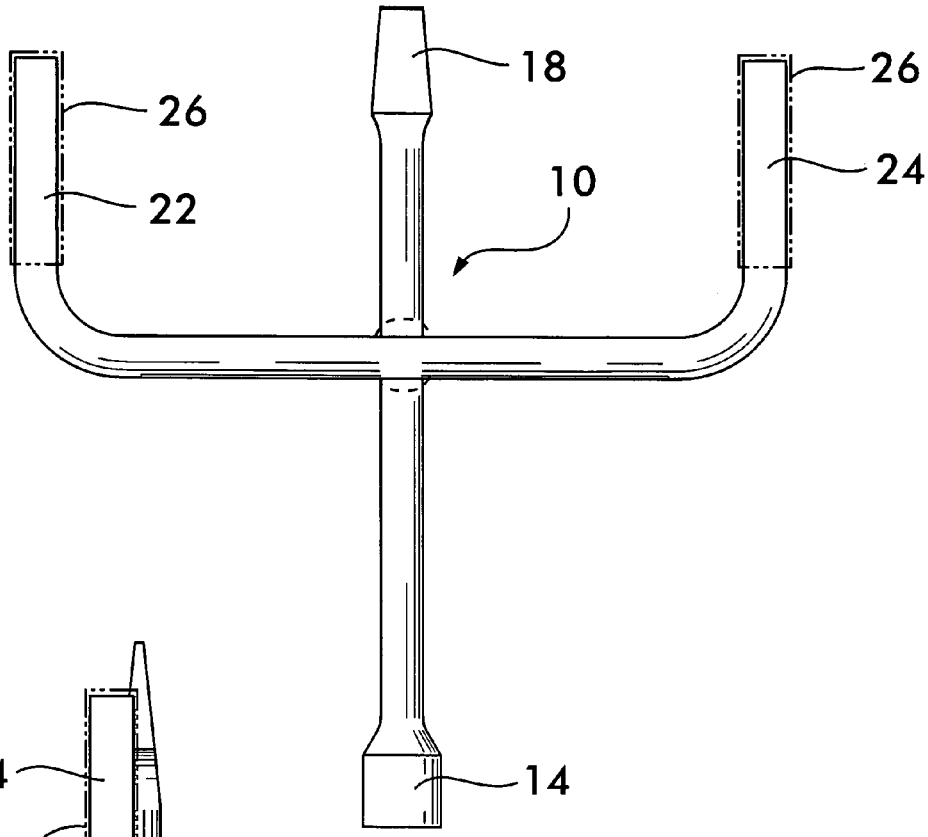
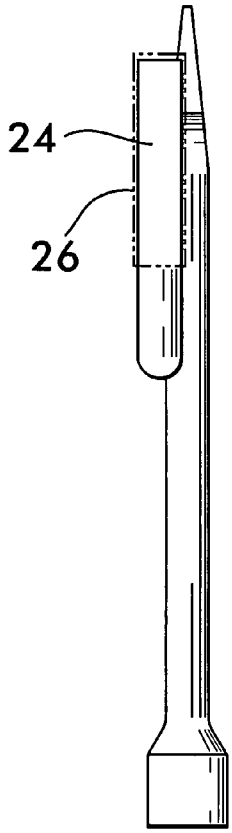
FIG.26

LUG WRENCH

CROSS-REFERENCE TO RELATED APPLICATIONS

This application is a continuation-in-part of U.S. Application Ser. No. 10/360,788, filed Jun. 13, 2002 now abandoned (which is a U.S. non-provisional patent application converted from U.S. Application No. 60/388,592, filed Jun. 13, 2002), the entire disclosure of which is hereby incorporated herein by reference.

FIELD OF THE INVENTION

The present invention relates generally to lug wrenches for tightening and loosening lug nuts for retaining wheels of vehicles.

BACKGROUND OF THE INVENTION

Lug wrenches typically include a socket for receiving a lug nut (wheel nut) and a handle extending from the socket. The handle has a length sufficient to permit a person to manually apply a sufficient levered force to the socket to tighten or loosen a lug nut. Various lug wrenches are well known in the art.

Such lug wrenches are often sold as tools in auto supply and hardware stores, and at car shows or similar exhibitions. Additionally, many auto manufacturers include a lug wrench as original equipment in a tool kit of their vehicles.

One popular style of lug wrench is the L-shaped lug wrench. Such lug wrenches typically have a handle extending at an oblique angle with respect to the socket's axis to help avoid interference of the handle with the wheel, tire, or ground while loosening or tightening a lug nut of a vehicle's wheel.

Pneumatic or other power-driven equipment typically used by auto mechanics, auto manufacturers, etc. often applies more torque to a lug nut than many motorists can easily apply with a conventional lug wrench, e.g. approximately 120 ft-lbs. This makes it particularly difficult for such a motorist to loosen lug nuts to remove a wheel from the motorist's vehicle.

This difficulty is particularly acute with the L-shaped lug wrench because the L-shaped handle and the angle of the handle relative to the socket's axis. These features cause the application of turning force to the socket and nut to be unbalanced. This tends to cause the lug wrench to slip off of the lug nut and/or inhibits application of sufficient torque before slipping off of the nut.

To overcome this difficulty, various T-shaped lug wrenches have been manufactured in which handle portions extend substantially equal distances from and transversely to the axis of a rod bearing the socket. Various X-shaped wrenches (cruciform or cross wrenches) are known that provide differently sized sockets at each end of the wrench. Such T and X wrenches allow for a more balanced application of turning forces to a lug nut. See U.S. Pat. Nos. 1,282,028, 1,630,848, 2,738,694 and 3,587,366.

However, such T and X wrenches fail to provide an ergonomically sound wrench that provides a sufficient degree of balance for efficient application of turning force to a lug nut.

SUMMARY OF THE INVENTION

The present invention provides an ergonomically sound lug wrench providing for greater mechanical advantage and torque while promoting balanced application of turning forces and tending to reduce the risk of slipping of the wrench from a lug nut.

A lug wrench according to the present invention comprises a shank, a socket joined to an end of the shank and defining a recess for receiving a nut, a crossbar joined to the shank to extend transversely thereto and having first and second ends, a first handle member joined to the first end of the crossbar to extend transversely thereto, and a second handle member joined to the second end of the crossbar to extend transversely thereto. The crossbar is welded to the shank or integrally formed with the shank. The socket is preferably integrally formed with the shank. In one embodiment, an axis of the crossbar intersects an axis of the shank, while in an alternative embodiment, the axis of the crossbar crosses the axis of the shank at a distance therefrom.

Optionally, the lug wrench further comprises a wedge joined to an opposite end of the shank. The wedge may be used, for example, to pry a tire from a wheel rim. The wedge may be integrally formed with the shank. Preferably, the wedge is formed in a plane substantially defined by the crossbar.

Each of the handle members has first and second ends. In a certain embodiment, each of the first and second handle members extends substantially parallel to an axis of the shank. The crossbar may be joined to each of the handle members intermediate the respective first and seconds ends. Alternatively, the first and second handle members may be joined to the crossbar at their respective first ends, and extend from the crossbar in a direction toward or away from the socket, e.g. parallel or substantially parallel to an axis thereof.

DESCRIPTION OF THE DRAWINGS

FIGS. 1 and 2 are top and bottom plan views of a lug wrench in accordance with the present invention;

FIG. 3 is a left side view of the lug wrench of FIG. 1, the right side of the lug wrench being a mirror image of that shown in FIG. 3;

FIGS. 10 and 11 are top and bottom plan views of a lug wrench in accordance with another alternative embodiment of the present invention;

FIG. 12 is a left side view of the lug wrench of FIG. 10, the right side of the lug wrench being a mirror image of that shown in FIG. 12;

FIGS. 19 and 20 are top and bottom plan views of a lug wrench in accordance with yet another alternative embodiment of the present invention;

FIG. 21 is a left side view of the lug wrench of FIG. 19, the right side of the lug wrench being a mirror image of that shown in FIG. 21;

FIGS. 24 and 25 are top and bottom plan views of a lug wrench in accordance with yet another alternative embodiment of the present invention;

FIG. 26 is a left side view of the lug wrench of FIG. 24, the right side of the lug wrench being a mirror image of that shown in FIG. 24.

DETAILED DESCRIPTION

Figure 1:
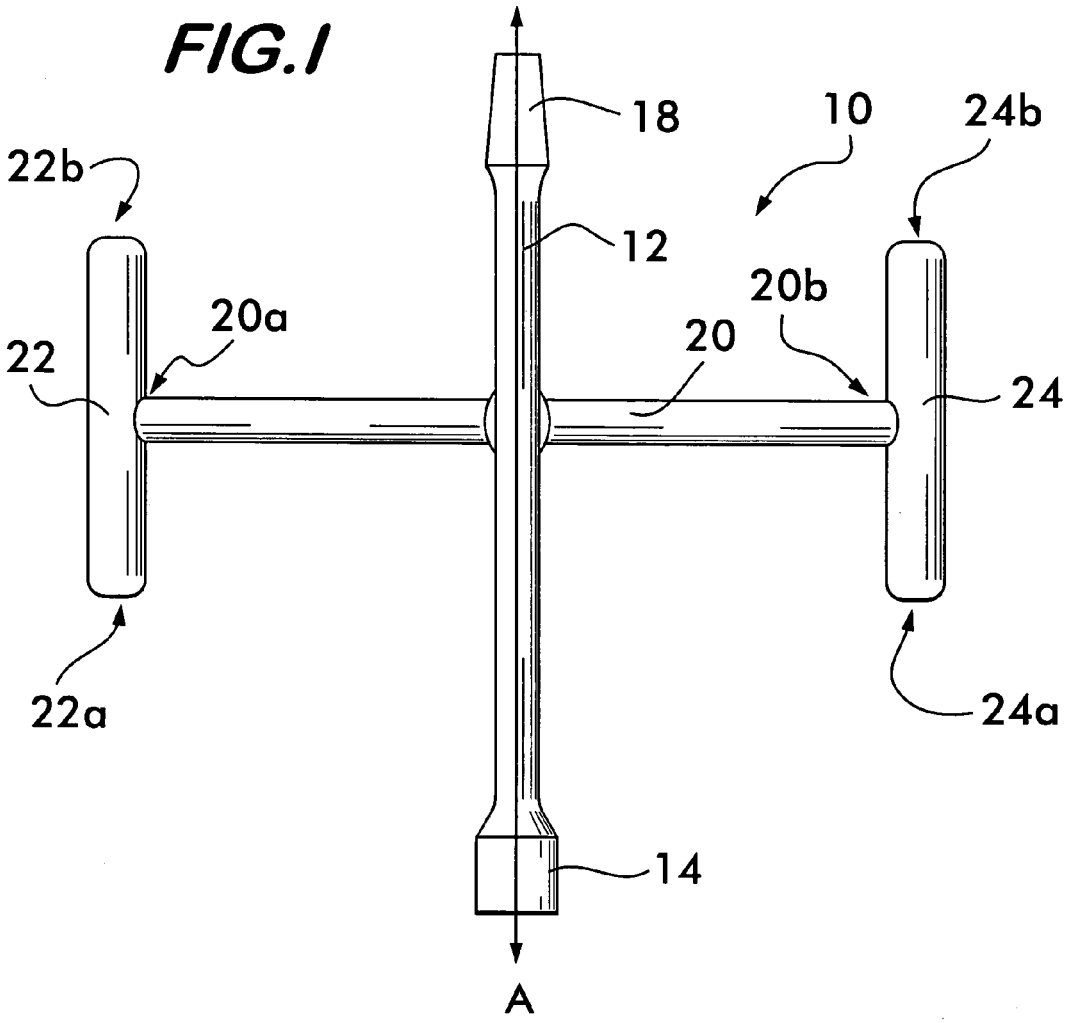

FIGS. 1–5 show a lug wrench 10 in accordance with a first embodiment of the present invention. As shown in FIGS. 1–5, the lug wrench 10 includes a central elongated shank 12 having a socket 14 joined to an end of the shank 12. The socket 14 defines a recess 16 for receiving a lug nut (not shown) of a vehicle (not shown). A wedge 18, is joined to an opposite end of the shank 12 for prying a tire from a wheel rim, etc., as is well known in the art of tire irons. Preferably, the socket 14 and wedge 18 are integrally formed with the shank as a unitary body. Optionally, the wedge 18 is formed in a plane substantially defined by a crossbar 20, as shown in FIG. 3. In other words, the sloped surfaces 18*a*, 18*b* of the wedge 18 are positioned such that raising and lowering the handles of the lug wrench causes a prying action when the crossbar is held in a substantially horizontal orientation.

The lug wrench 10 further comprises a crossbar 20 joined at the shank 12 to extend transversely thereto, e.g., at a 90 degree angle to the crossbar as shown in FIGS. 1 and 2. Crossbar 20 has first and second ends 20*a*, 20*b*, respectively. The first handle member 22 is joined to the first end 20*a* of the crossbar 20 to extend transversely thereto. The second handle member 24 is similarly joined to the second end 20*b* of the crossbar 20 to extend transversely to the crossbar 20. In this manner, the handle members 22, 24 may extend in generally the same direction as the shank 12. This allows for grasping of the handles 22, 24 in a particularly natural, ergonomically sound manner, because it orients the handles in positions corresponding to comfortable and natural positions of human hands, wrists and arms. Preferably each of the first and second handle members 22, 24 extends substantially parallel to an axis A of the shank 12, as shown in FIGS. 1 and 2.

Alternatively, the handle members 22, 24 may extend inwardly or outwardly (not shown) relative to the axis A of the shank 12 as seen from the perspective of the socket end 14 in FIG. 1, or the handle members 22, 24 may extend upwardly or downwardly out of the plane of the drawing (not shown) relative to the axis A of the shank 12 as seen from the perspective of FIG. 1, i.e. extending at an acute angle relative to the shank 12 out of the plane of the drawing.

Each of the handle members 22, 24 has respective first and second ends 22*a*, 22*b*, 24*a*, 24*b*. In the embodiments of FIGS. 1–5, 6–9, 10–14 and 15–18, the crossbar 20 is joined to each of the handle members 22, 24 intermediate, i.e. between, its respective first and second ends. In an alternative embodiment, as discussed below with reference to FIGS. 19–23 and 24–28, one end of each of the first and second handle members 22, 24 is joined to a respective end of the crossbar such that each handle member 22, 24 extends from the crossbar 20 in a direction away from the socket 14, as shown in FIGS. 19–23 and 24–28.

These arrangements of the handle members 22, 24 relative to the shank 12 and socket 14 provide a particularly ergonomically sound wrench that allows for balanced application of turning forces and prevents slipping of the socket 14 from a lug nut during application of such torque. This is particularly true when the lug wrench is symmetrical about the axis A of the shank 12, e.g. symmetrical about a plane that intersects the shank 12, e.g. through the axis A, and is perpendicular to an axis B of the crossbar 20. In this manner, one half of the lug wrench is essentially a mirror image of the other, thereby providing for a particularly well-balanced, lug wrench and facilitating application of torque. Additionally, the relatively large hand-graspable handle members 22, 24, and their orientation, allow for adequate gripping force even in rain, snow, or other adverse weather conditions.

Figure 4:
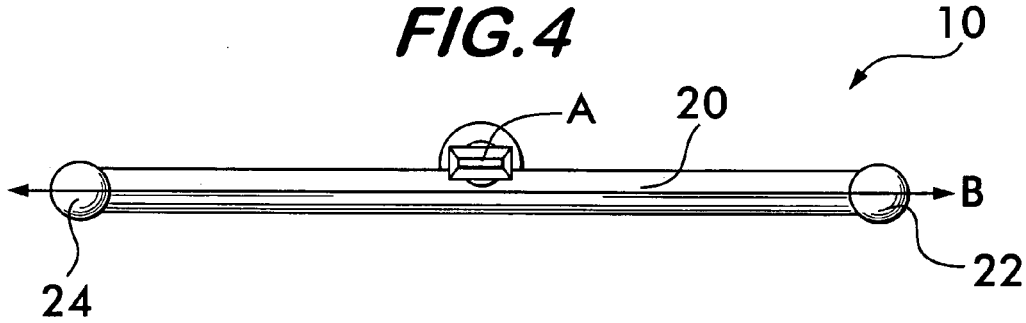
FIGS. 4 and 5 are front and rear end views of the lug wrench of FIG. 1.
Figure 5:
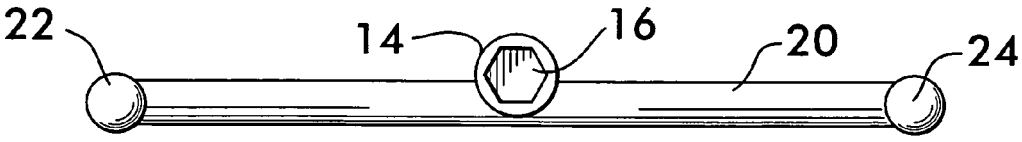

Preferably, the crossbar 20 is a discrete member that is welded to the shank 12. In such an embodiment, as shown in FIGS. 1–5, an axis B of the crossbar 20 crosses the axis A of the shank 12 at a distance therefrom, as best shown in FIG. 4. This configuration is shared by the embodiments of FIGS. 10–14, 19–23 and 24–28.

Preferably, the lug wrench 10 is constructed of steel or another adequately rigid material and is chrome plated. Further, the lug wrench is preferably configured with a socket dimensioned for receiving a conventionally-sized lug nut (in metric or English units of dimension) and is distributed as original equipment with a vehicle. In other words, the lug wrench's socket is sized to fit the lug nuts of a wheel of a vehicle with which it is to be distributed.

Figure 6:
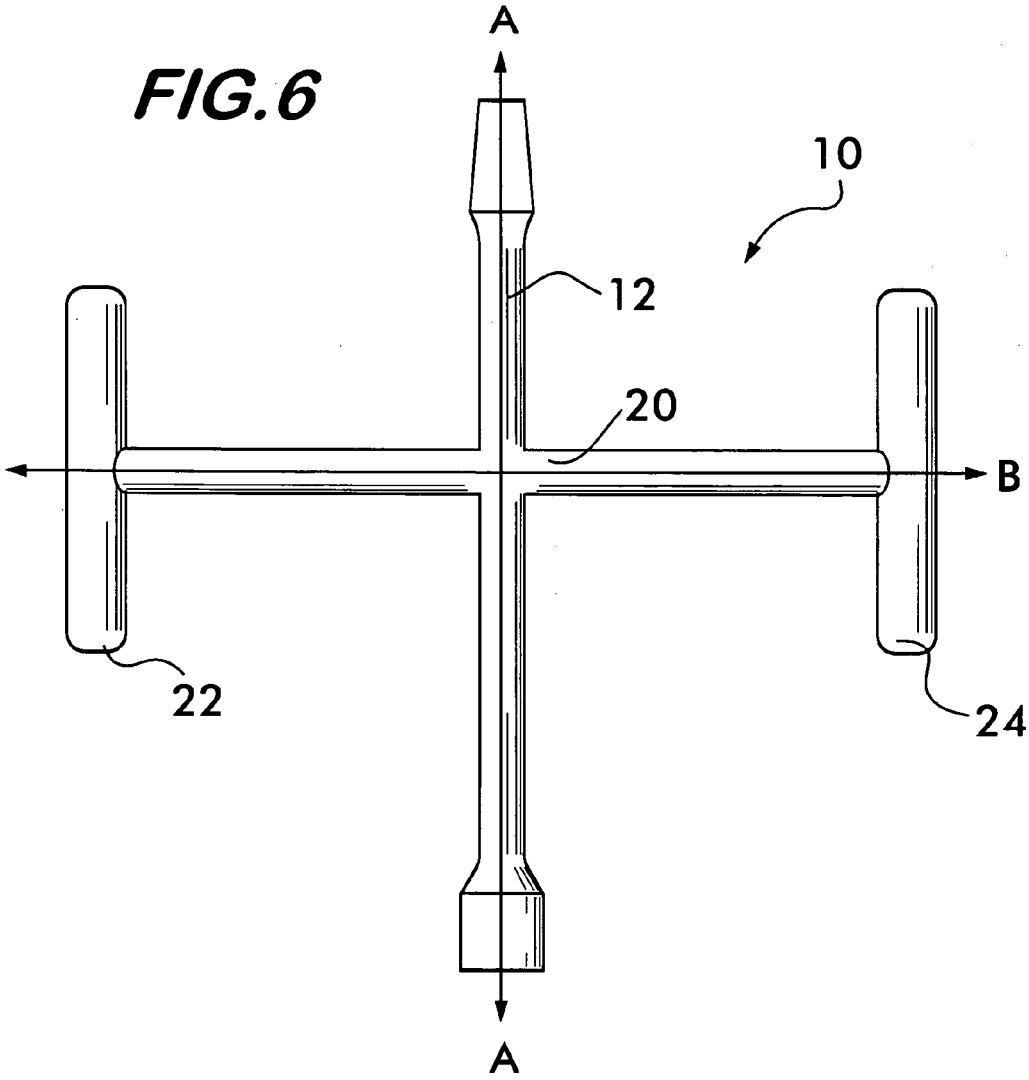
FIG. 6 is a top plan view of a lug wrench in accordance with an alternative embodiment of the present invention, the bottom plan view of the lug wrench being a mirror image of that shown in FIG. 6.
Figure 8:
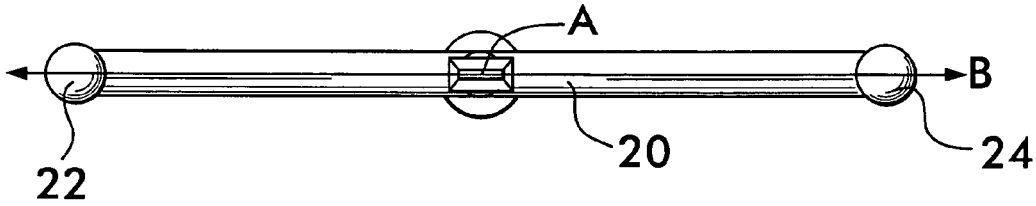
FIGS. 8 and 9 are front and rear end views of the lug wrench of FIG. 6.
Figure 9:
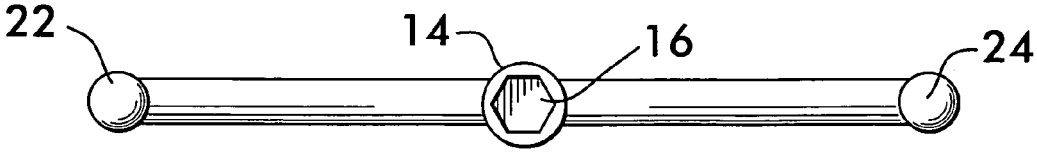
Figure 7:
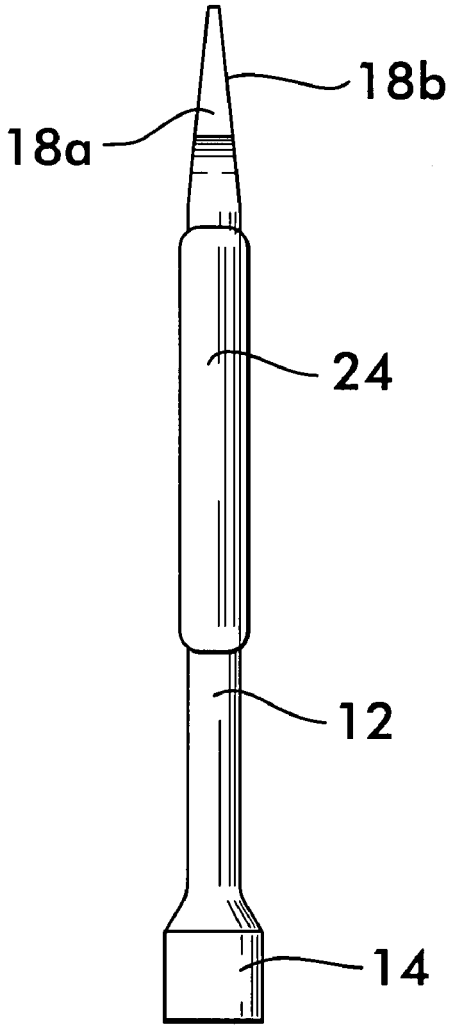
FIG. 7 is a left side view of the lug wrench of FIG. 6, the right side view of the lug wrench being a mirror image of that shown in FIG. 7.
Figure 16:
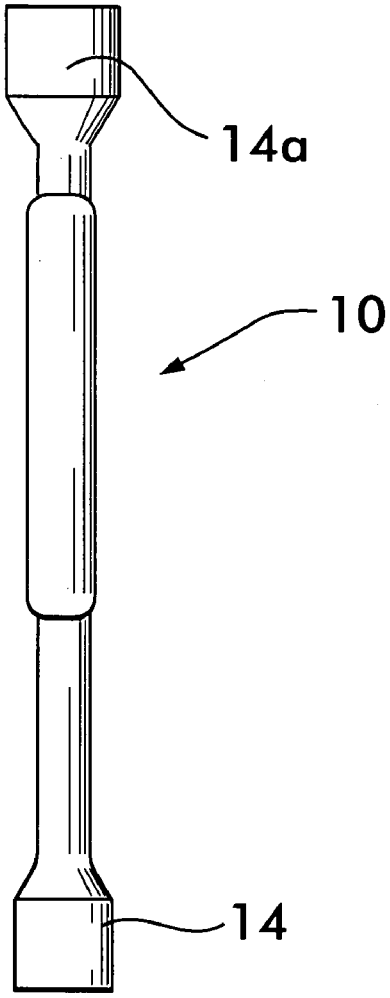
FIG. 16 is a left side view of the lug wrench of FIG. 15, the right side of the lug wrench being a mirror image of that shown in FIG. 16.

The lug wrench 10 shown in FIGS. 6–9 is similar to that shown in FIGS. 1–5. However, the shank 12, crossbar 20, handle members 22, 24, wedge 18, and socket 14, are all integrally formed as a unitary body, e.g. in a single casting, forging, etc. In such an embodiment, for example, the axis B of the crossbar 20 may intersect the axis A of the shank 12, as best shown in FIGS. 6 and 8. This configuration is shared by the alternative embodiment of FIGS. 15–18.

Figure 10:
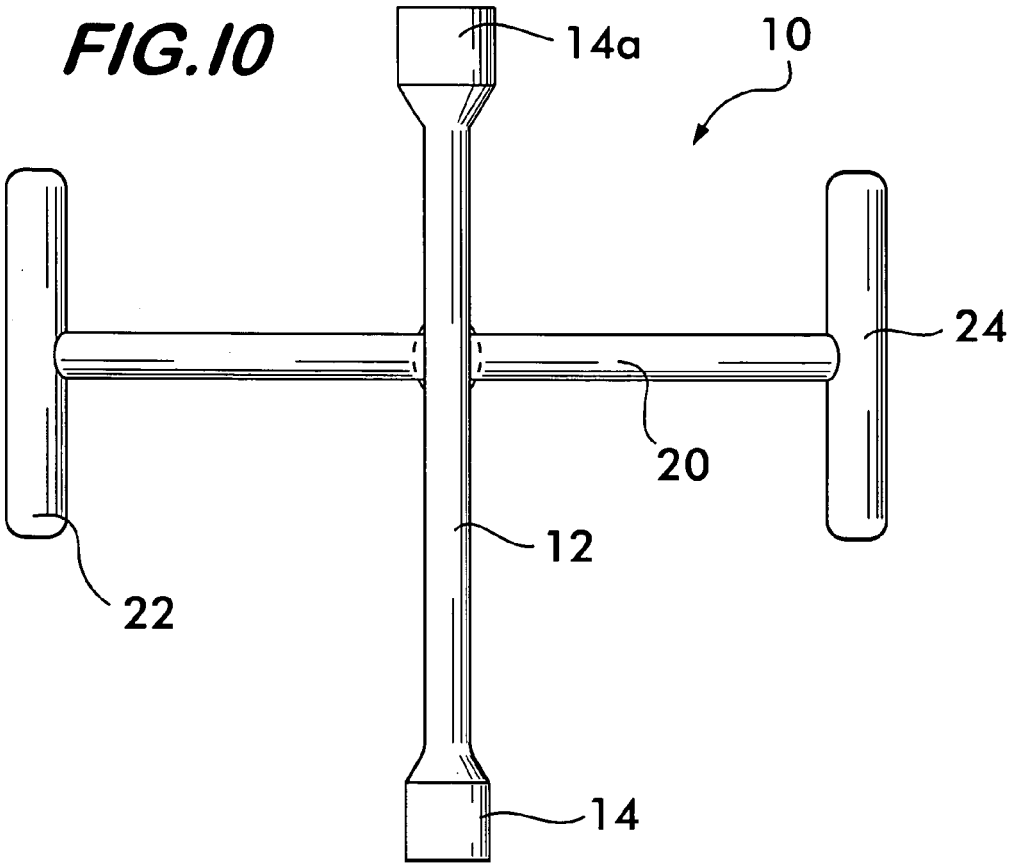
Figure 13:
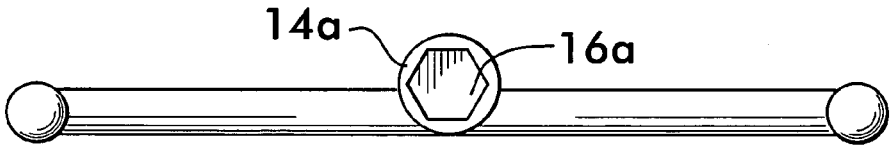
FIGS. 13 and 14 are front and rear end views of the lug wrench of FIG. 10.
Figure 14:
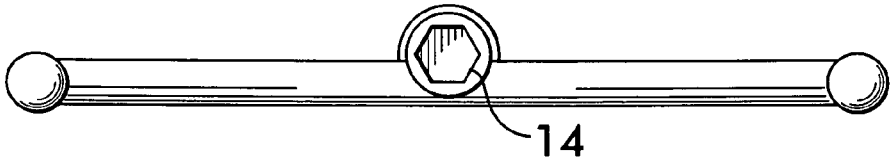

The lug wrench 10 shown in FIGS. 10–14 is similar to that shown in FIGS. 1–5. However, as best shown in FIGS. 10 and 13, this alternative embodiment of the lug wrench includes a second socket 14*a* defining a second recess 16*a* instead of the wedge 18 shown in FIGS. 1–5. The second socket 14*a* is preferably sized to receive a lug nut of a size different from that of the first socket 14.

Figure 15:
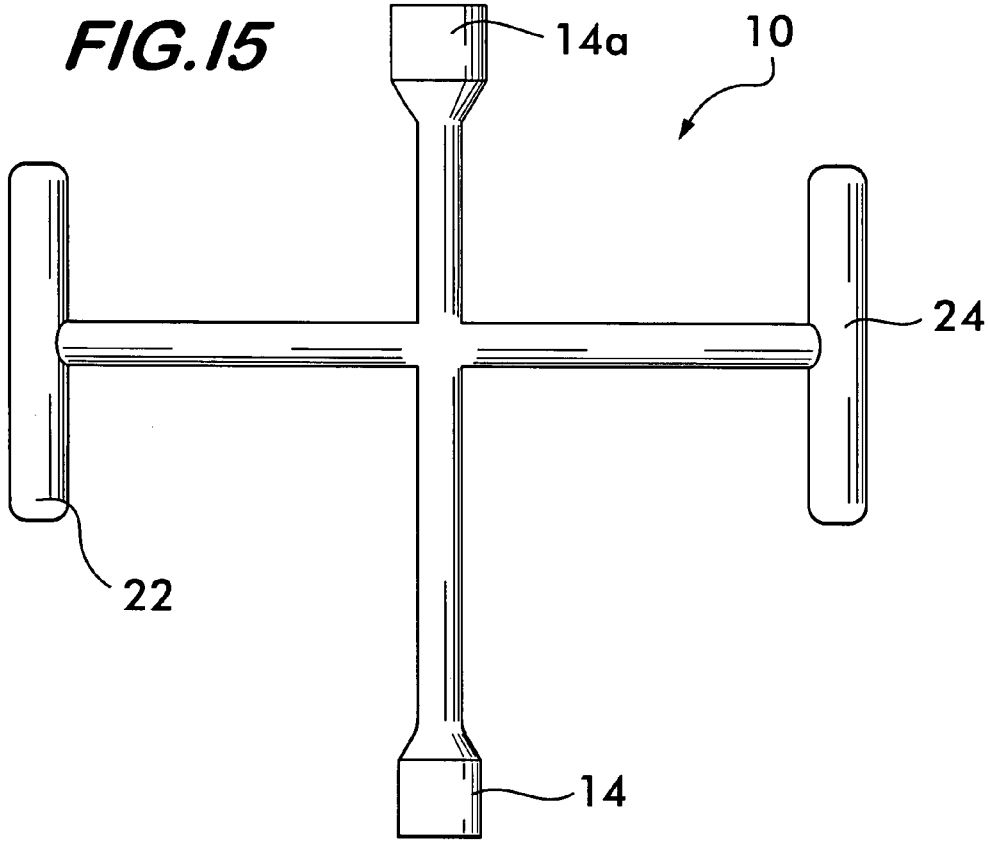
FIG. 15 is a top plan view of the lug wrench in accordance with yet another alternative embodiment of the present invention, the bottom plan view of the lug wrench being a mirror image of that shown in FIG. 15.
Figure 17:
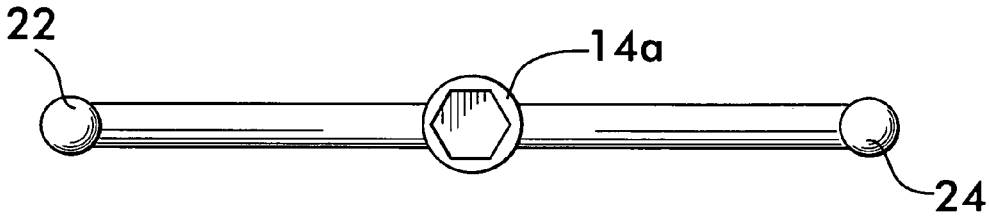
FIGS. 17 and 18 are front and rear end views of the lug wrench of FIG. 15.
Figure 18:
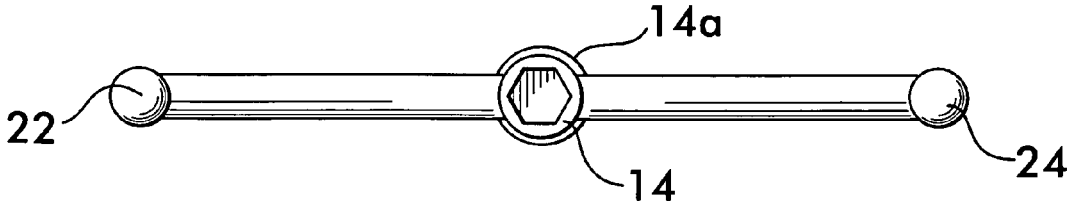
Figure 19:
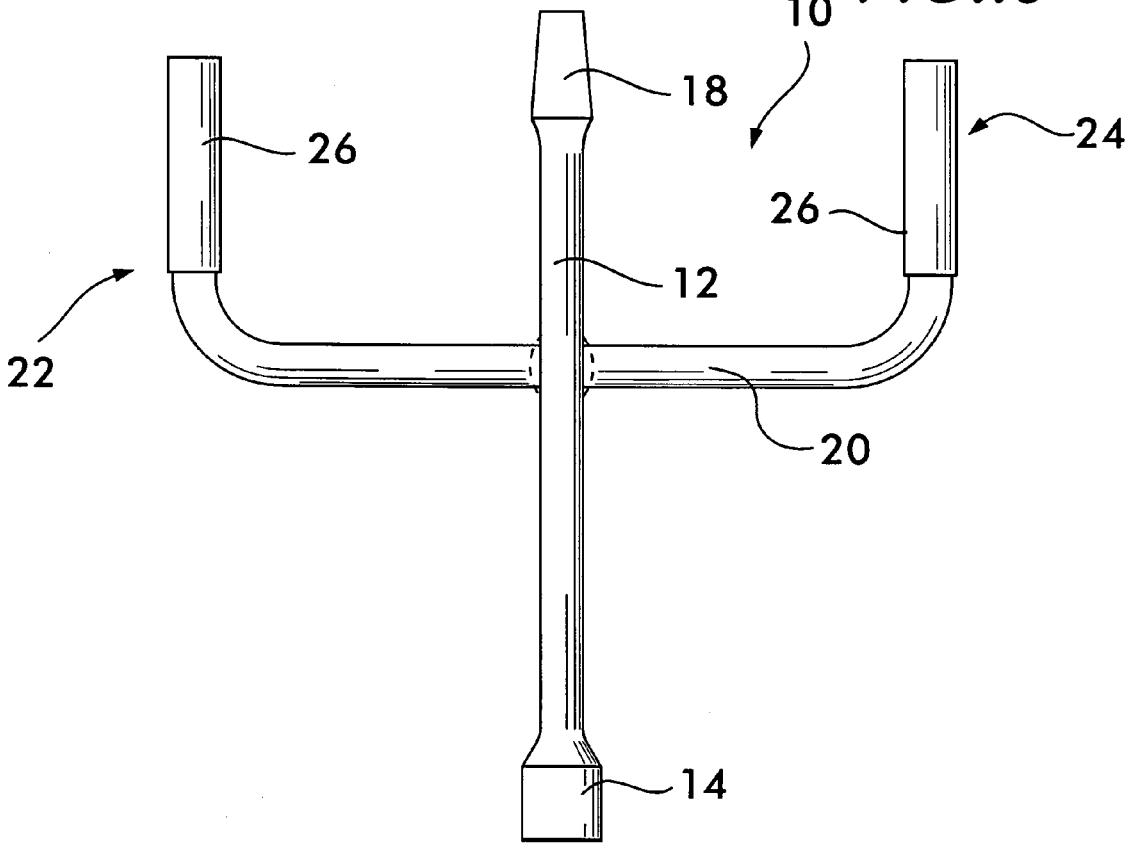
Figure 22:
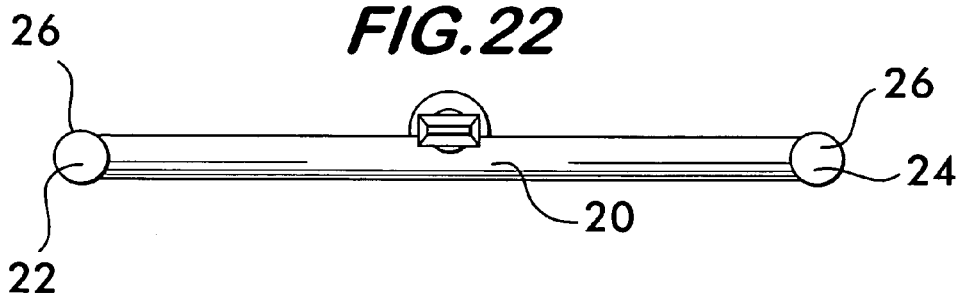
FIGS. 22 and 23 are front and rear end views of the lug wrench of FIG. 19.
Figure 23:
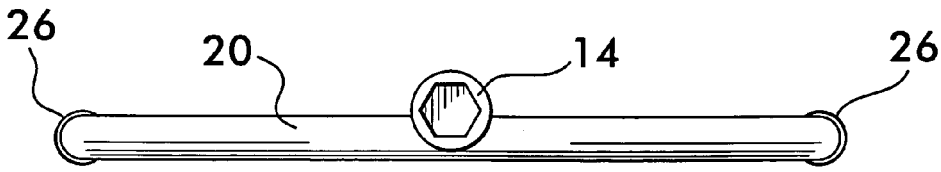
Figure 24:
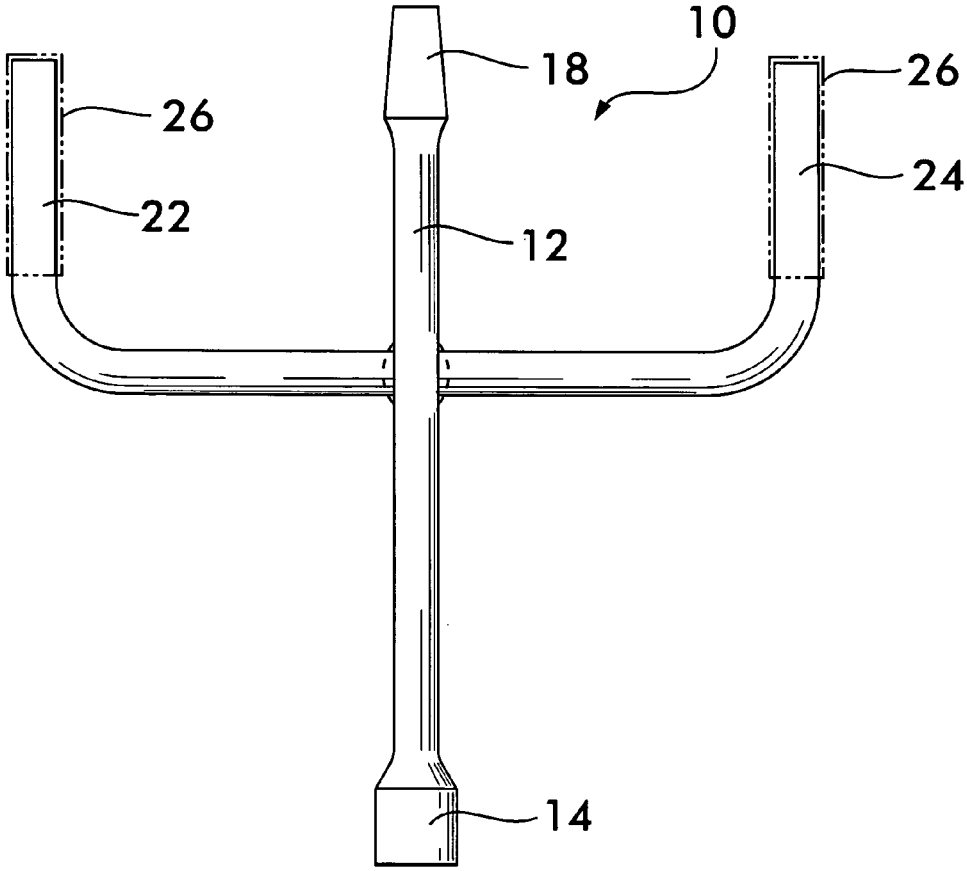
Figure 27:
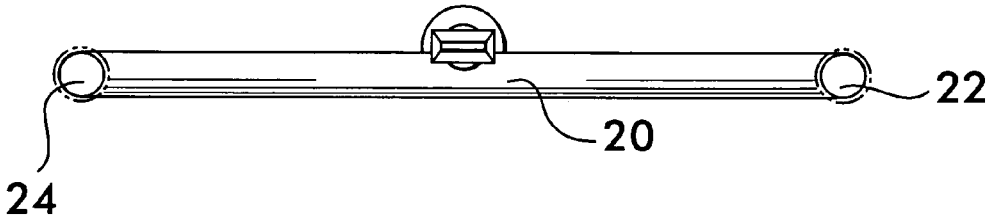
FIGS. 27 and 28 are front and rear end views of the lug wrench of FIG. 24.
Figure 28:
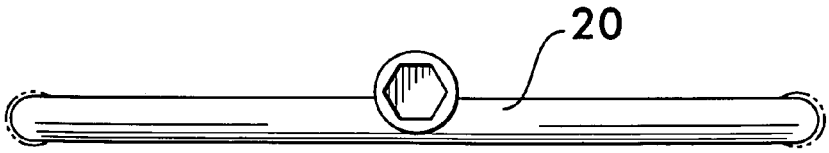

The lug wrench 10 shown in FIGS. 15–18 is similar to that shown in FIGS. 6–9. However, as shown in FIG. 15, this alternative embodiment of the lug wrench 10 includes a second socket 14*a*, similar to that of the embodiment of FIGS. 10–14.

The lug wrench 10 shown in FIGS. 19–23 is an alternative embodiment in which the handle members 22, 24 are shortened to conserve materials, manufacturing costs, etc. and may be integrally formed with the crossbar 20. In this embodiment, each of the first and second handle members 22, 24 is joined to the crossbar at one of their ends such that each handle member 22, 24 extends from the crossbar 20 in a direction away from the socket 14. Optionally, rubber, plastic or other easily grippable non-metal sleeves 26 may be provided, as shown in FIGS. 19–23, by sliding them onto the handle members to provide hand grips. For example, such sleeves 26 may have a smooth, ribbed, knurled or other outer surface to enhance manual gripping of same. The sleeve may be friction fit to the handle members 22, 24 or adhered by a suitable adhesive. Alternatively, the handle members themselves 22, 24 may have a smooth, ribbed, knurled or other outer surface to enhance manual gripping of same.

The embodiment shown in FIGS. 24–28 is similar to that shown in FIGS. 19–23, but shows that the rubber or plastic sleeves (hand grips) are optionally provided on such handle members, and how such sleeves 26 may be applied.

Optionally, the lug wrench 10 of FIGS. 19–28 may be configured similarly to any of the lug wrenches of FIGS. 1–18. In particular, a lug wrench 10 having the crossbar and handle configuration shown in FIGS. 19–28 may alternatively have two sockets, may be formed as a unitary body, may have a shank and crossbar having intersecting axes, etc. Additionally, a lug wrench in accordance with the present invention may have a crossbar 20 and handle 22, 24 configuration similar to that shown in FIGS. 19–28, but be configured such that handles 22, 24 extend in an opposite direction, i.e. toward the socket 14 shown in FIG. 19.

In use, the lug wrench 10 may be used to tighten or loosen a lug nut (not shown) by engaging the socket 14 with the nut and grasping a respective handle member 22, 24, and respective hand grip sleeve 26 if applicable, in each hand. By pushing on one handle member and pulling on the other, turning force may be applied to a nut in a balanced manner in either a clockwise or counterclockwise direction to tighten or loosen lug nuts, respectively. This is particularly true when the handle members are positioned symmetrically about the axis of the shank 12 and/or socket 14. Additionally, the wedge 18 may be used in a prying motion by pulling or pushing simultaneously on both handle members in a like direction, e.g. to remove a hubcap from a wheel.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A lug wrench comprising:

an elongated shank;

a socket joined to an end of said shank and defining a recess for receiving a nut;

a crossbar fixedly joined to said shank to extend transversely to said shank, said crossbar having first and second ends;

a first handle member fixedly joined to said first end of said crossbar, said first handle member extending transversely to said crossbar in fixed spatial relationship to said socket; and a second handle member fixedly joined to said second end of said crossbar, said second handle member extending transversely to said crossbar in fixed spatial relationship to said socket;

whereby said shank, said crossbar and said first and second handle members are fixedly joined to one another to form a rigid unitary body, wherein said first and second ends of said crossbar terminate at said first and second handle members, and wherein said lug wrench is symmetrical about a plane intersecting an axis of said shank.

2. The lug wrench of claim 1, wherein said crossbar is welded to said shank.

3. The lug wrench of claim 1, wherein said crossbar is integrally formed with said shank as a unitary body.

4. The lug wrench of claim 1, wherein said socket is integrally formed with said shank as a unitary body.

5. The lug wrench of claim 1, wherein said crossbar and said shank have respective axes, and wherein said axis of said crossbar intersects said axis of said shank.

6. The lug wrench of claim 1, wherein said crossbar and said shank have respective axes, and wherein said axis of said crossbar crosses over said axis of said shank at a distance from said axis of said shank.

7. The lug wrench of claim 1, further comprising a wedge joined to an opposite end of said shank.

8. The lug wrench of claim 7, wherein said wedge is integrally formed with said shank as a unitary body.

9. The lug wrench of claim 7, wherein said wedge is formed in a plane substantially defined by said crossbar.

10. The lug wrench of claim 1, wherein each of said first and second handle members extends substantially parallel to an axis of said shank.

11. The lug wrench of claim 10, wherein each of said first and second handle members has first and second ends, and said crossbar is joined to each of said first and second handle members intermediate said respective first and seconds ends.

12. A lug wrench comprising:

an elongated shank;

a socket joined to an end of said shank and defining a recess for receiving a nut;

a crossbar joined to said shank to extend transversely to said shank, said crossbar having first and second ends;

a first handle member fixedly joined to said first end of said crossbar, said first handle member extending transversely to said crossbar; and a second handle member fixedly joined to said second end of said crossbar, said second handle member extending transversely to said crossbar;

wherein said lug wrench is symmetrical about a plane that intersects said shank and is perpendicular to an axis of said crossbar.

13. The lug wrench of claim 12, further comprising a wedge joined to an opposite end of said shank.

14. The lug wrench of claim 12, wherein each of said first and second handle members extends substantially parallel to an axis of said shank.

15. The lug wrench of claim 12, wherein each of said first and second handle members has first and second ends, and said crossbar is joined to each of said first and second handle members intermediate said respective first and seconds ends.

16. The lug wrench of claim 12, further comprising a non-metal hand grip fixedly mounted on each of said first and second handle members.

17. A lug wrench comprising:

an elongated shank;

a socket joined to an end of said shank and defining a recess for receiving a nut;

a wedge joined to an opposite end of said shank;

a crossbar joined to said shank to extend transversely to said shank, said crossbar having first and second ends and being joined to said shank at a midpoint portion of said crossbar;

a first handle member joined to said first end of said crossbar, said first handle member extending transversely to said crossbar to form a first hand-graspable handle; and a second handle member joined to said second end of said crossbar, said second handle member extending transversely to said crossbar to form a second hand-graspable handle;

wherein said lug wrench is symmetrical about a plane that intersects said shank and is perpendicular to an axis of said crossbar.

18. The lug wrench of claim 17, wherein said first and second handle members extend from said crossbar in a direction away from said socket.

19. The lug wrench of claim 17, further comprising a non-metal hand grip fixedly mounted on each of said first and second handle members.

20. The lug wrench of claim 17, wherein each of said first and second handle members has first and second ends, and said crossbar is joined to each of said first and second handle members intermediate said respective first and seconds ends.

* * * * *